US005775631A

United States Patent [19]

Murakami

[11] Patent Number: 5,775,631

[45] Date of Patent: Jul. 7, 1998

[54] SUPPORT SHAFT ASSEMBLY FOR STABLY SUPPORTING ROLLS OF MATERIAL

[75] Inventor: Motoaki Murakami, Wakayama, Japan

[73] Assignee: Noritsu Koki Co., Ltd., Wakayama, Japan

[21] Appl. No.: 731,979

[22] Filed: Oct. 23, 1996

[30] Foreign Application Priority Data

Oct. 25, 1995 [JP] Japan ..... 7-277689

[51] Int. Cl.[6] ..... B65H 75/24

[52] U.S. Cl. ..... 242/573.9

[58] Field of Search ..... 242/573, 573.9, 242/575.3, 573.1, 573.2, 573.3, 573.7, 573.8

[56] References Cited

U.S. PATENT DOCUMENTS

| | | | |
|---|---|---|---|
| 717,117 | 12/1902 | Phail | 242/573 |
| 1,964,585 | 6/1934 | Larsen | 242/573.9 |
| 2,733,873 | 2/1956 | Petersen | 242/573.9 |
| 3,738,588 | 6/1973 | Ayers | 242/575.3 X |
| 5,011,094 | 4/1991 | Azuma | 242/573.1 |

FOREIGN PATENT DOCUMENTS

| | | | |
|---|---|---|---|
| 383082 | 8/1990 | European Pat. Off. | 242/573.1 |
| 1258552 | 9/1986 | U.S.S.R. | 242/573 |
| 746693 | 3/1956 | United Kingdom | 242/573.9 |

*Primary Examiner*—Daniel P. Stodola
*Assistant Examiner*—Gregory J. Strimbu
*Attorney, Agent, or Firm*—Wenderoth, Lind & Ponack, L.L.P.

[57] ABSTRACT

A support shaft to efficiently fix a roll of material thereon. The support shaft includes a core support roll having a plurality of axial guide grooves formed in an outer periphery thereof. Each guide groove has a tapered bottom sloping outwardly. In each guide groove is inserted a slider plate having a tapered side and biased inwardly by a ring coil spring provided around the slider plates. A knob is inserted in the core support roll at one end thereof. The knob has a radially outwardly extending guide pin inserted in an inclined guide hole formed in the core support roll. By turning the knob, the guide pin is moved along the guide hole. The knob is thus moved axially, so that the slider plates are pushed axially, thus causing the slider plates to move along the tapered bottoms of the guide grooves and also move radially outwardly to press against the inner surface of the roll.

14 Claims, 3 Drawing Sheets

SUPPORT SHAFT ASSEMBLY FOR STABLY SUPPORTING ROLLS OF MATERIAL

BACKGROUND OF THE INVENTION

This invention relates to a support shaft assembly for rotatably supporting a roll such as a paper roll.

A photographic printer is a device for printing images on negative film onto photographic paper unrolled from a paper roll positioned in a paper magazine and developing the thus printed images. Such a paper roll is rotatably supported on a support shaft inserted in the core of the paper roll and supported by bearings provided in the paper magazine.

Among known support shafts of this type is one proposed by the present invention in Examined Japanese Utility Model Publication 5-27698. This support shaft has a core shaft and a conical boss rotatably mounted on the core shaft and having in its outer periphery a plurality of taper-bottomed grooves. A slider is inserted in each groove. Pushed at their ends, the sliders are urged radially outwardly of the boss against the inner surface of the paper roll core to support the paper roll. The plurality of sliders can stably support the paper roll because they are pressed uniformly against the inner surface of the core.

This conventional support shaft has a knob in threaded engagement with one end of the core shaft. By turning the knob, the knob is moved axially and pressed against the ends of the sliders. As the sliders are pushed by the knob, the sliders are caused to protrude radially outwardly from the outer periphery of the boss. In order to protrude the sliders sufficiently, the knob has to be rotated by several turns. It is therefore desired to provide a support shaft which can more easily secure the paper roll in position.

Another problem with the conventional support shaft is that the pressure applied from the sliders to the paper roll varies with the number of turns by which the knob is rotated. This means that it is impossible to hold the paper roll with a predetermined constant force.

An object of the invention is to provide a support shaft assembly which can fix a roll such as a paper roll in a short time and with a predetermined constant force.

SUMMARY OF THE INVENTION

According to the invention, there is provided a support shaft assembly for supporting a roll and including a core shaft and a core support roll rotatably mounted on the core shaft. The core support roll has an outer periphery having therein a plurality of guide grooves that are circumferentially spaced and that extend axially between opposite ends of the core support roll. Each of the guide grooves has a tapered or inclined surface sloping upwardly or radially outwardly toward one end of the core support roll. Slider plates are inserted in respective guide grooves. A coil spring is mounted around the core support roll for urging the slider plates inwardly. Each of the slider plates has an inner side face tapered in the same direction as the tapered surface of the respective guide groove. A knob is provided inside the core support roll near one end thereof for pressing the slider plates when the knob is moved toward the other end of the core support roll. A guide pin is provided on the outer periphery of the knob and extends into a guide hole formed in the core support roll. The guide hole has a guide portion inclined in a circumferential direction of the core support roll.

A compression coil spring having a greater spring force than the coil spring is mounted between the knob and the presser plates in a non-compressed state.

BRIEF DESCRIPTION OF THE DRAWINGS

Other features and objects of the present invention will become apparent from the following description made with reference to the accompanying drawings, in which.

DETAILED DESCRIPTION OF THE EMBODIMENT

Figure 1:
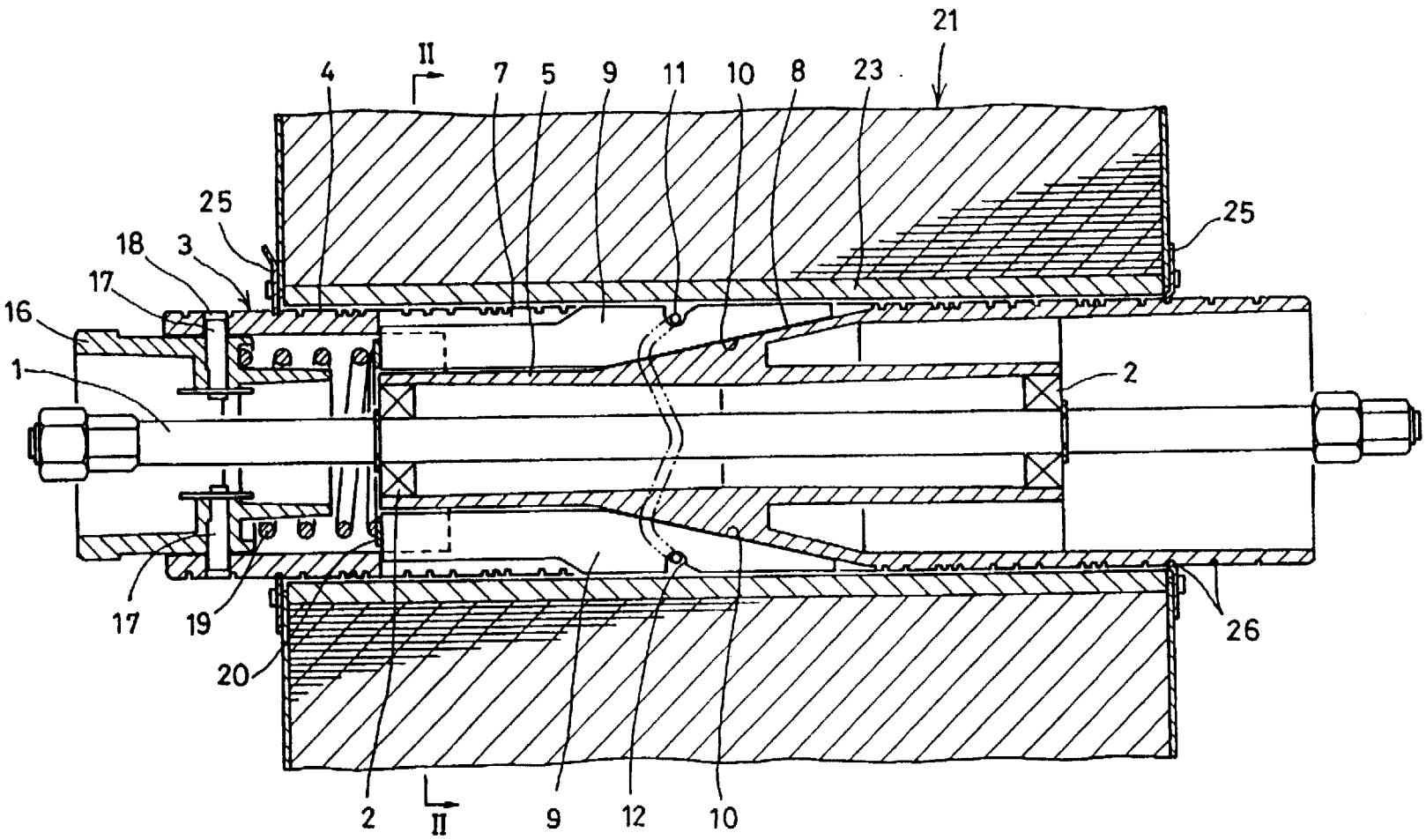
FIG. 1 is a longitudinal sectional view of an embodiment of the invention.
Figure 2:
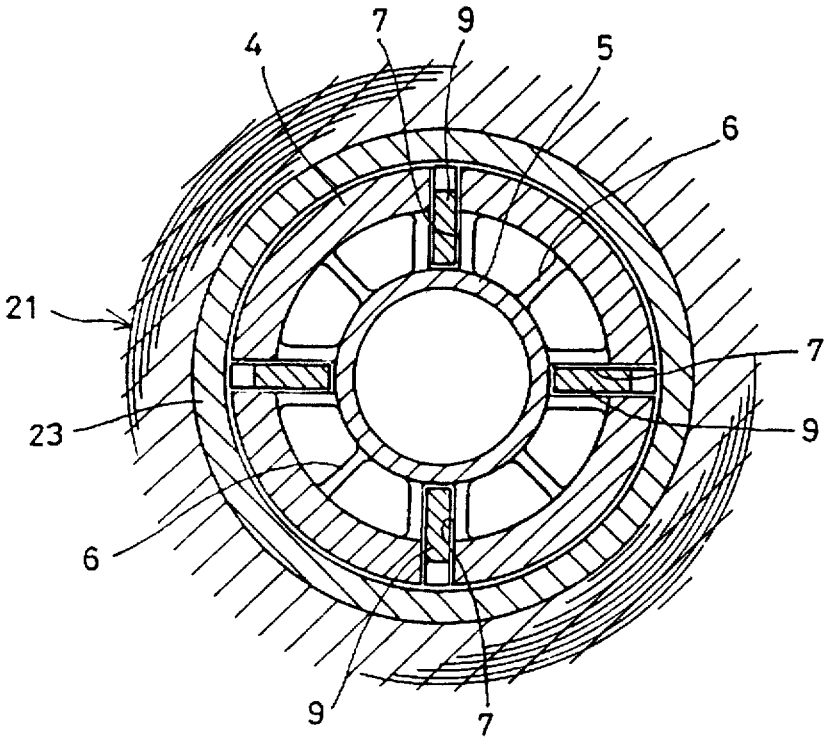
FIG. 2 is a sectional view taken along line II—II of FIG. 1.
Figure 3:
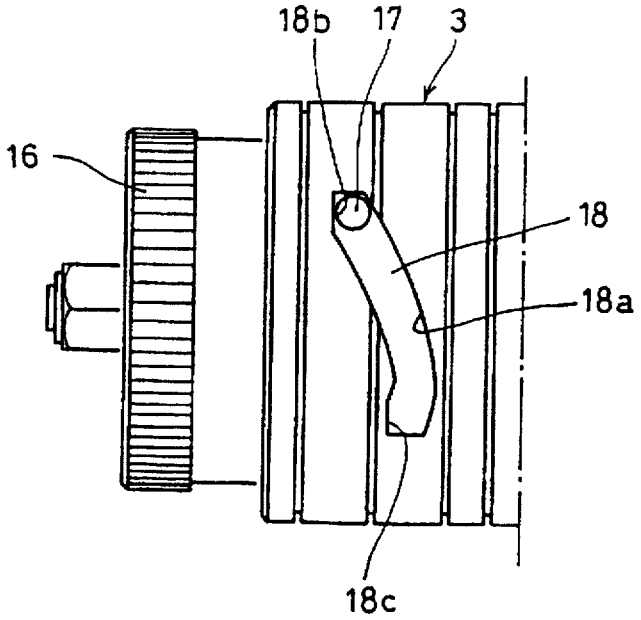
FIG. 3 is a plan view showing a guide hole.

As shown in FIGS. 1–3, a core support roll 3 is supported rotatably through a pair of bearings 2 on a core shaft 1. The roll 3 includes an outer sleeve 4, an inner sleeve 5 shorter than the outer sleeve, and a plurality of ribs 6 extending radially between and interconnecting the sleeves 4 and 5. The inner sleeve 5 is positioned axially midway between opposite ends of the outer sleeve 4. One end (the lefthand end in FIG. 1) of each rib 6 is spaced somewhat inwardly from the corresponding end of the inner sleeve S. The other end of each rib 6 is aligned or flush with the other end of the inner sleeve 5.

The outer periphery of the roll 3 has guide grooves 7, each extending axially and radially between pairs of ribs 6 (FIG. 2). The grooves 7 each have one end open in the outer sleeve 4. The bottom of each groove 7 is partially defined by the inner sleeve 5. The remainder of the groove bottom is a tapered surface 8 inclining radially outwardly toward the other end of the groove 7.

A slider plate 9 is placed in each guide groove 7. The front or one end portion of the slider plate 9 has a tapered surface 10 facing radially inwardly of the roll 3. The tapered surface 10 is inclined at the same angle as the tapered surface 8. The slider plate 9 has a radially outer side which extends axially of the roll 3. This side has two stages or axially spaced sections. With one end of the slider plate 9 abutting the corresponding end of the associated groove 7, one stage is higher or radially outwardly offset (i.e. the right section as viewed in FIG. 1) and is aligned with the outer periphery of the roll 3 or is retracted radially inwardly of the roll 3. The other stage is radially inwardly offset.

Figure 4:
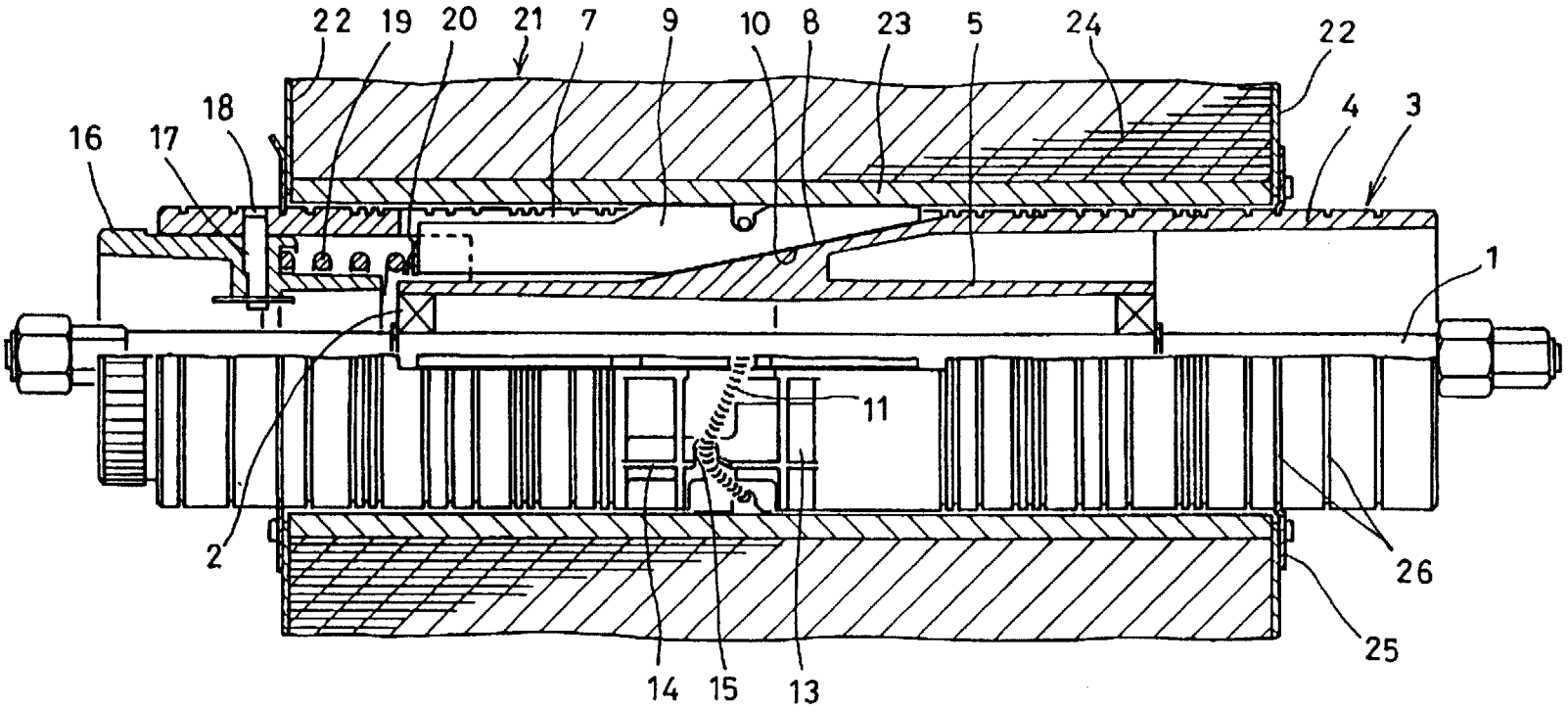
FIG. 4 is a partially sectional showing a manner of securing a roll.

If a spring 11 was mounted on the outer periphery of the roll 3, it would not be possible to insert the roll 3 into the core 23 of a roll 21. Therefore, as shown in FIG. 4, the roll 3 has a middle portion 13 of reduced or smaller outer diameter. The portion 13 has formed on its periphery axial ribs 14 spaced at circumferential intervals. Each rib 14 has a notch 15 into which the spring 11 engages so as not to protrude beyond the outer periphery of the roll 3. The notches 15 are positioned nearer to one end of the roll 3 than are wedge notches 12 formed in slider plates 9, so that the spring 11 extends in a circumferentially zigzag fashion to urge the slider plates 9 toward the one end of the roll 3. Alternatively, the ribs 14 may be omitted and the spring 11 may be supported on the middle portion 13 of the roll 3.

A tubular knob 16 is inserted in one end of the outer sleeve 4 of the core support roll 3. The knob 16 has radially outwardly extending guide pins 17 received in guide holes 18 formed in the outer sleeve 4 at the one end thereof. Each guide hole 18 comprises an inclined guide portion 18*a* extending obliquely or inclined with respect to both axial and circumferential directions of the outer sleeve 4 (FIG. 3).

and first and second pin engaging portions 18b and 18c provided at opposite ends of the guide portion 18a and having surface portions extending in the circumferential direction of the outer sleeve 4.

A compression coil spring 19 and a ring 20 are disposed between the knob 16 and the slider plates 9. When the guide pins 17 of the knob 16 are received in the first engaging portion 18b of each guide hole 18, the coil spring 19 is not compressed, so that the slider plates 9 are not biased by the coil spring 19. When the coil spring 19 is compressed by the knob 16, it will bias the slider plates 9 with a force that is greater than the biasing force of the ring-shaped coil spring 11 that acts on the slider plates 9 to urge them radially inwardly. FIG. 1 shows the state in which the guide pins 17 are received in the first engaging portions 18b of the respective guide holes 18. In this state, the coil spring 19 is not compressed, so that the slider plates 9 are not biased by the spring 19. That is, the slider plates 9 are biased inwardly solely by the force of the ring-shaped coil spring 11.

FIG. 4 shows a roll 21 supported on the core support roll 3 and comprising a core 23 and flanges 22 provided at opposite ends of the core 23. Photographic paper 24 is wound around the core 23.

To support the roil 21 in position, the core support roll 3 is inserted into the core 23, and the knob 16 is turned to move the guide pins 17 toward the respective second engaging portions 18c. By turning the knob 16, the guide pins 17 are moved along the inclined guide portion 18a of each guide hole 18, so that the knob 16 moves axially while rotating. By the axial movement of the knob 16, the slider plates 9 are biased axially by the compression coil spring 19. The slider plates 9 thus move along the respective tapered surfaces 8, thus being caused to protrude radially outwardly from the core support roll 3 and to press the core 23 radially outwardly by pressing against the inner periphery thereof. By the time the guide pins 17 fit in the second engaging portions 18c, the slider plates 9 press against the inner periphery of the core 23, thus supporting the roll 21 stably on the core support roll 3.

By turning the knob 16, the slider plates 9 are pushed by the knob 16 through the compression coil spring 19 and abut the inner periphery of the core 23. By further turning the knob 16, the compression coil spring 19 is compressed. It is thus possible to press the slider plates 9 against cores 23 having different inner diameters with a predetermined constant force. Thus, the support shaft assembly according to this invention can support various rolls 21 having cores 23 with different inner diameters with high reliability and stability.

In order to support the roll 21 more stably, axial movement thereof is prevented by attaching a ring 25 made up of two split halves to each flange 22. An inner edge of each ring engages in one of a plurality of grooves 26 formed in the outer periphery of the core support roll 3.

To disengage the roll 21 from the support roll 3, the knob 16 is turned in the reverse direction to release the pressure on the slider plates 9. Thus, the slider plates 9 are moved radially inwardly under the force of the ring-shaped coil spring 11.

What is claimed is:

1. A support shaft assembly for supporting a roll of material, said assembly comprising:

a core shaft;

a core support roll rotatably supported on said core shaft;

said core support roll having an outer periphery having therein a plurality of circumferentially spaced and axially extending guide grooves, each said guide groove having a tapered surface inclined radially outwardly toward a first axial end of said core support roll;

a plurality of slider plates, each said slider plate being positioned within a respective said guide groove, and each said slider plate having an inner side face inclined in the same direction as said tapered surface of said respective guide groove;

a coil spring positioned around said core support roll and urging each said slider plate inwardly toward said respective guide groove;

said core support roll having at a second axial end thereof a guide hole having a guide portion extending in a direction inclined with respect to both axial and circumferential directions of said core support roll;

a knob having a guide pin extending therefrom; and said knob being positioned at said second axial end of said core support roll with said guide pin extending into said guide hole, and said knob being rotatable relative to said core support roll such that said guide pin is moved along said guide portion of said guide hole, thereby causing said knob to move axially relative to said core support roll to cause movement of said slider plates toward said first axial end of said core support roll, whereby said inner side faces of said slider plates slide along said tapered surfaces of said guide grooves and said slider plates are moved radially outwardly of said guide grooves.

2. An assembly as claimed in claim 1, further comprising a compression coil spring mounted between said knob and said slider plates.

3. An assembly as claimed in claim 2, wherein said compression coil spring is not compressed when said knob is in an axially outermost position relative to said core support roll, and said compression coil spring is compressed upon axial movement of said knob away from said axially outermost position toward said slider plates.

4. An assembly as claimed in claim 3, wherein said compression coil spring has a spring force greater than that of said coil spring.

5. An assembly as claimed in claim 2, wherein said compression coil spring has a spring force greater than that of said coil spring.

6. An assembly as claimed in claim 1, wherein said guide pin extends outwardly from an outer periphery of said knob.

7. An assembly as claimed in claim 6, wherein said knob is mounted within said second axial end of said core support roll.

8. An assembly as claimed in claim 1, wherein said knob is mounted within said second axial end of said core support roll.

9. An assembly as claimed in claim 1, wherein said core support roll includes an inner sleeve, an outer sleeve positioned radially outwardly and coaxially of said inner sleeve, and a plurality of ribs extending radially between and connecting said inner sleeve and said outer sleeve.

10. An assembly as claimed in claim 9, wherein each said guide groove is defined between a circumferentially adjacent pair of said ribs.

11. An assembly as claimed in claim 9, wherein said inner sleeve has an axial length less than that of said outer sleeve, and said inner sleeve is positioned axially midway between opposite ends of said outer sleeve.

12. An assembly as claimed in claim 9, wherein said guide hole is formed in said outer sleeve.

13. An assembly as claimed in claim 1, wherein said guide hole further includes first and second pin engaging portions at opposite ends of said guide portion, said first and second pin engaging portions being spaced from each other in both said axial and circumferential directions of said core support roll.

14. An assembly as claimed in claim 13, wherein said first and second pin engaging portions have respective surface portions extending in said circumferential direction of said core support roll.

* * * * *